US005844861A

United States Patent [19]

Maurer

[11] Patent Number: 5,844,861

[45] Date of Patent: Dec. 1, 1998

[54] ATHLETIC JUMP DURATION TIMING APPARATUS

[76] Inventor: Gregory C. Maurer, 46 New Haven Rd., Vergennes, Vt. 05491

[21] Appl. No.: 896,983

[22] Filed: Jul. 18, 1997

[51] Int. Cl.[6] ..... G04B 47/00; G04F 8/00; A43B 3/00; A03B 23/00

[52] U.S. Cl. ..... 368/10; 368/110; 36/132; 482/8

[58] Field of Search ..... 368/9, 10, 107–113; 36/132, 136, 137, 114; 73/172; 128/774, 779; 364/550, 556; 482/8, 14, 51, 80

[56] References Cited

U.S. PATENT DOCUMENTS

| | | | |
|---|---|---|---|
| 4,797,864 | 1/1989 | Stano et al. | 368/111 |
| 4,993,004 | 2/1991 | Loizeaux | 368/107 |
| 5,125,647 | 6/1992 | Smith | 428/118 |
| 5,297,110 | 3/1994 | Ohira et al. | 368/110 |
| 5,343,445 | 8/1994 | Chernak | 368/110 |
| 5,452,269 | 9/1995 | Chernak | 368/10 |
| 5,471,405 | 11/1995 | Marsh | 364/556 |

*Primary Examiner*—Vit W. Miska
*Attorney, Agent, or Firm*—Thomas N. Neiman

[57] ABSTRACT

An athletic jump duration timing apparatus is designed to measure the time from when an individual initiates a jump until he or she lands from the jump or stride. The apparatus will measure and display the elapsed time of the individual's flight or "hang time". A timing device is positioned in a housing. The timing device is activated by a sensor positioned under a weight bearing surface. A signal is sent to a controller which simultaneously activates two previously zeroed timers. These timers or counters begin counting the impulses from a clock generator. When the sensor senses a weight, the signal is given to the controller to cease the flow of impulses, which freezes the two counters. The event counter is cleared back to zero and the hold counter displays the hang time for the count value. Subsequent jumps are measured and the hold counter displays the jump with the longest hang time by comparing each jump against the event counter.

5 Claims, 2 Drawing Sheets

ATHLETIC JUMP DURATION TIMING APPARATUS

BACKGROUND OF THE INVENTION

This invention pertains to timing devices and, in particular, to an athletic jump duration timing apparatus for use by individuals to measure the amount of "hang time" or flight time they can achieve from a standing or a running start in order to see improvements during conditioning or training.

The duration of the flight time or hang time of an individual can be of interest to the participant for training purposes and for competition either against one's personal best or against the performance of others. Currently, measuring approximate flight time can be accomplished by manually starting a stop watch when one initiates the jump and then stopping the watch when the individual makes first contact with the ground. This requires a great deal of precision by the individual operating the stopwatch or requires the individual jumping to perform a number of steps at the same time. Both judgment and reaction time can effect the accuracy of the readings.

Many devices do provide some sort of measurement in one way or another, but they do not provide the user the specific elapsed flight time reading in a simple and direct manner while minimizing the inaccuracies present with hand timing of flight or hang time.

What is needed is an athletic jump duration timing apparatus that can be connected to a pressure sensing unit in a weight bearing surface that can measure changes associated with the presence and absence of weight on the weight bearing surface to start and stop a timing mechanism in order to measure and display the elapsed flight or "hang" time.

It is the object of this invention to teach an athletic jump duration timing apparatus which avoids the disadvantages and limitations, recited above in previous measurement devices. Another object of this invention is to provide an apparatus that is cost effective, can be provided integrally in the weight bearing surface that can be easy to install and use and, at the same time, be safe, accurate and effective.

SUMMARY OF THE INVENTION

Particularly, it is the object of this invention to teach an athletic jump duration apparatus, for use in providing information regarding the elapsed flight time of a individual, said structure comprising a housing for the containing of said apparatus; a pressure sensing system positioned between the individual and a weight bearing area of equipment used in a particular sport; a timing unit positioned within said housing for determining the elapsed flight time of said individual; a circuitry system connecting said pressure sensing system with said time unit; and a display unit for showing the elapsed flight time of said individual.

BRIEF DESCRIPTION OF THE DRAWING

Further objects and features of this invention will become more apparent by reference to the following description taken in conjunction with the following figures, in which.

DETAILED DESCRIPTION OF THE PREFERRED EMBODIMENT

Figure 1:
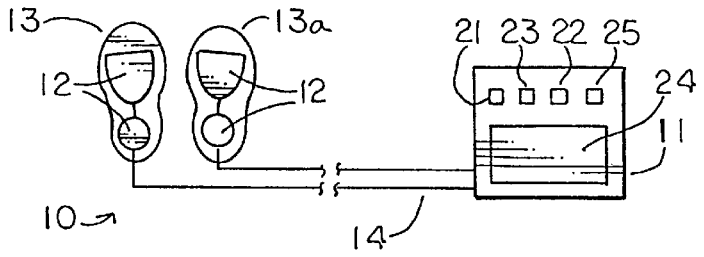
FIG. 1 is a front elevational view of the novel athletic jump duration timing apparatus.
Figure 2:
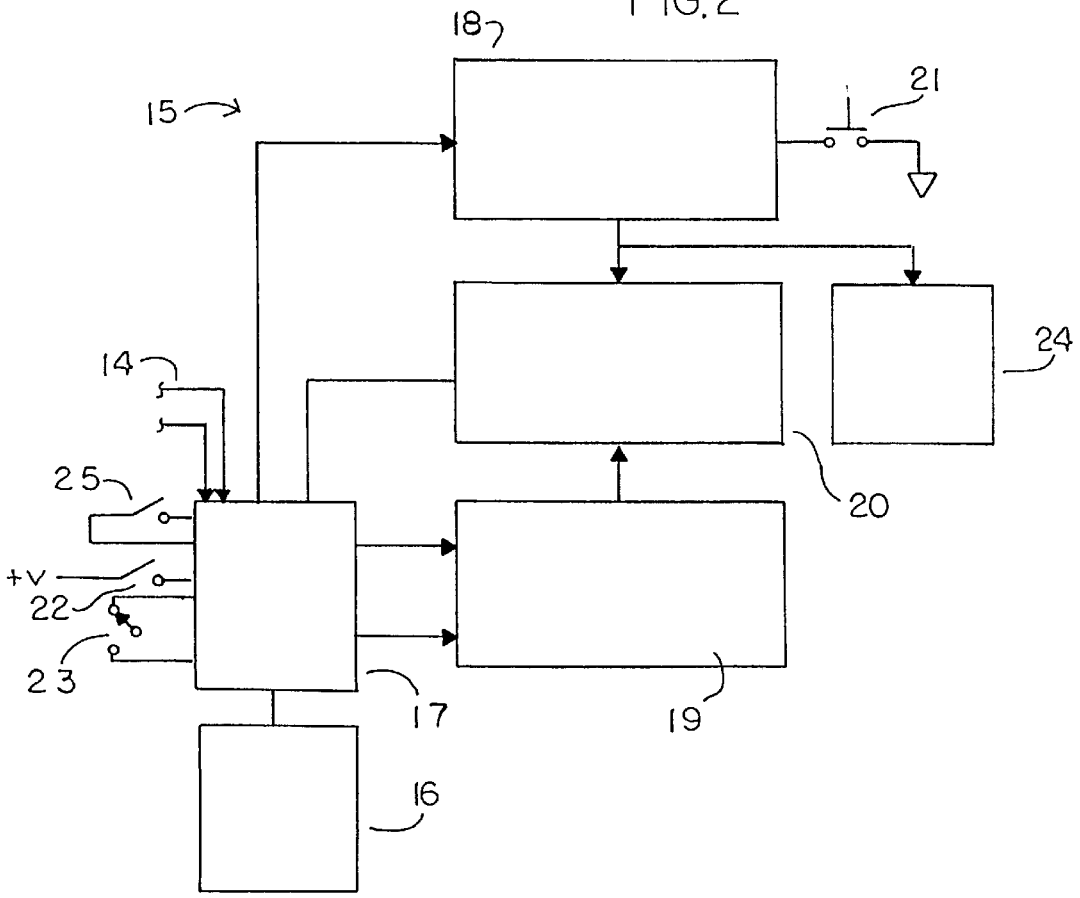
FIG. 2 is an electrical block diagram of the electrical system of the apparatus.
Figure 3:
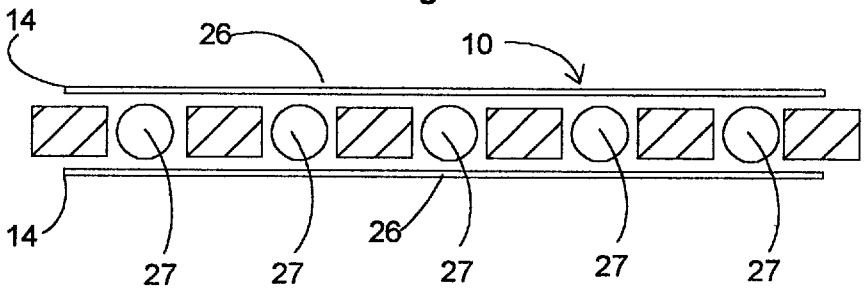
FIG. 3 is a cross sectional view of the weight bearing surface of the athletic jump duration timing apparatus.

As shown in the figures, the novel athletic jump duration timing apparatus 10 comprises a housing 11 that contains a timing unit. A pressure sensor array 12 is comprised of units positioned in weight bearing surfaces 13 and 13*a* such as the sole of a shoe or a jumping pad. The pressure sensor array 12 is electronically connected 14 to the timing unit 15. The pressure sensor array 12 is composed of conductive sheets 26 of material that are inserted above and below the weight bearing areas of a cushioned shoe insert. Conductive units 27 are inserted between the two conductive sheets and activate and deactivate the apparatus by the presence or absence of weight on the weight bearing areas of the shoe insert. The timing unit 15 consists of a clock generator 16 with a control system 17. The control system feeds the output from the clock generator 16 to the hold counter 18, the event counter 19 and the comparator 20. The timing unit 15 also has a manual reset switch 21 for zeroing out the hold counter 18, and an on and off switch 22 and a mode selector 23. The numerical readout of the hold counter 18 is shown in a display 24.

The manual reset switch 21 zeros out the display and resets the timing unit 15 to zero. From that point on, any unweighting beyond a threshold level of the pressure sensor array 12 enables the clock controller 17 and the clock controller 17 starts the counters 18 and 19 and the duration is concurrently displayed on the digital display 24. When the sensor array 12 note the presence of weight, the timing is stopped and the display is ended and shown at the value of the flight or hang time. As the next jump occurs, the clock generator 16, clock control 17 and event counter 19 have been automatically zeroed out and begin timing the second jump. The hold counter 18 and display 24 are frozen and still show the previous time. If the second jump lasts as long as the first jump did, this is sensed by the comparator 20 which then allows the hold timer 18 and display 24 to advance until the end of the jump. At the end of the jump, the hold counter 18 and display 24 are then frozen. The event counter 19, clock generator 16 and clock control 17 are reset automatically to zero. Therefor, the result shown in the display is the longest duration jump or "hang times" of the individual. The circuitry requires a power supply, either alternating current or direct current as necessary for the particular apparatus, either stationary or portable.

The apparatus can be adapted for a number of measurements. The sensors can be positioned under the saddle of a horse, the fork structure of a bike or motorcycle or the skis of a snowmobile to measure air time on jumps. The sensors can be embedded in a sole of an athletic shoe, boot or skate and the housing can be made to be carried on a waistband or harness to make it completely portable. A number of alternate embodiments or features could be installed in the apparatus. As previously mentioned, the unit can possess an alternate mode switch 23 which would make the unit measure the total elapsed time of all the jumps in total. A freeze switch 25 can be added to hold the display as is until desired in order to allow the individual to show others the result.

While I have described my invention in connection with specific embodiments thereof, it is clearly to be understood that this is done only by way of example and not as a limitation to the scope of my invention as set forth in the objects thereof and in the appended claims.

I claim:

1. An athletic jump duration timing apparatus, for use in providing information regarding the elapsed flight time of an individual, said structure comprising:

a structure comprising a housing for the containing of said apparatus;

a removable pressure sensing system positioned between the individual and a weight bearing area of equipment used in the particular sport for being able to be positioned as necessary in any number of standard footwear;

said removable pressure sensing system having a sensor for sensing the relative absence or presence of weight;

said sensor comprises an array of pressure sensitive momentary switches;

a timing unit positioned within said housing for determining the elapsed flight time of said individual;

said timing unit comprises clock means for providing impulses that are initiated by a signal from said removable pressure sensing system;

said timing unit further comprises a plurality of counters for measuring said impulses from said clock means;

said plurality of counters having an automatic hold counter for measuring the longest jump duration time;

said plurality of counters further having an event counter for measuring the timing of the current jump, said event counter automatically zeroing out after each jump;

said plurality of counters further having an automatic comparator for measuring the timing of both said counters and adjusting said hold counter according;

a circuitry system connecting said pressure sensing means with said timing unit; and a display unit for showing the elapsed flight time of said individual.

2. An athletic jump duration timing apparatus, according to claim 1, wherein:

said housing comprising a construction of a protective material.

3. An athletic jump duration timing apparatus, according to claim 1, wherein:

said circuitry means comprises a wired system from said pressure sensing means to said timing system.

4. An athletic jump duration timing apparatus, according to claim 1, wherein:

said circuitry system having a manually resettable override for zeroing out said hold counter when desired;

said circuitry system further having a on and off control switch;

said circuitry system further having a system freeze switch;

said circuitry system further having a totalizer unit; and said circuitry means further having a power source.

5. An athletic jump duration timing apparatus, according to claim 1, wherein:

said display system comprises means for providing a readout of the numerical display of the said hold counter.

* * * * *